US009281594B2

(12) United States Patent
Funayama et al.

(10) Patent No.: US 9,281,594 B2
(45) Date of Patent: Mar. 8, 2016

(54) CONNECTOR

(71) Applicant: IRISO ELECTRONICS CO., LTD., Kanagawa (JP)

(72) Inventors: Daisuke Funayama, Kanagawa (JP); Shigeru Mitsuzuka, Kanagawa (JP); Tomisaburo Yamaguchi, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/423,029

(22) PCT Filed: Aug. 26, 2013

(86) PCT No.: PCT/JP2013/072772

§ 371 (c)(1),
(2) Date: Feb. 20, 2015

(87) PCT Pub. No.: WO2014/038427

PCT Pub. Date: Mar. 13, 2014

(65) Prior Publication Data

US 2015/0244093 A1 Aug. 27, 2015

(30) Foreign Application Priority Data

Sep. 5, 2012 (JP) ..... 2012-195386

(51) Int. Cl.
*H01R 13/62* (2006.01)
*H01R 12/91* (2011.01)
(Continued)

(52) U.S. Cl.
CPC ..... *H01R 12/91* (2013.01); *H01R 12/716* (2013.01); *H01R 13/20* (2013.01); *H01R 13/46* (2013.01); *H01R 13/6315* (2013.01); *H01R 35/02* (2013.01)

(58) Field of Classification Search
CPC ..... H01R 12/91
USPC ..... 439/247, 248
See application file for complete search history.

(56) References Cited

U.S. PATENT DOCUMENTS 5,873,742 A * 2/1999 McHugh ..... H01R 12/716 439/247
6,155,858 A * 12/2000 Ozawa ..... H01R 13/6315 439/248

(Continued)

FOREIGN PATENT DOCUMENTS

JP 61-284075 12/1986
JP 06-231840 8/1994

(Continued)

OTHER PUBLICATIONS

International Search Report for corresponding International PCT Application No. PCT/JP2013/072772, dated Oct. 29, 2013.

*Primary Examiner* — Neil Abrams
(74) *Attorney, Agent, or Firm* — Hauptman Ham, LLP

(57) ABSTRACT

A connector comprising a first connector provided with first terminals each of which has a movable portion formed so that a dimension in its width direction is larger than a dimension in its thickness direction to be elastically deformed in a fore-and-aft direction (Y direction) of the connector, and a second connector provided with second terminals each of which has a movable portion formed so that a dimension in its thickness direction is larger than a dimension in its width direction to be elastically deformed in a width direction (X direction) of the connector. As compared with a terminal formed so as to be sufficiently elastically deformable in both of the fore-and-aft direction and the width direction of the connector, it is possible to increase a cross-sectional area of each of the movable portions, so that a permissible value of current of each of the terminals can be increased.

3 Claims, 9 Drawing Sheets

(51) Int. Cl.

| | |
|---|---|
| ***H01R 13/46*** | (2006.01) |
| ***H01R 35/02*** | (2006.01) |
| ***H01R 12/71*** | (2011.01) |
| ***H01R 13/20*** | (2006.01) |
| ***H01R 13/631*** | (2006.01) |

(56) References Cited

U.S. PATENT DOCUMENTS

| | | | | |
|---|---|---|---|---|
| 7,374,432 | B2 * | 5/2008 | Koguchi | H01R 12/725 439/247 |
| 7,635,274 | B2 * | 12/2009 | Fukazawa | H01R 12/716 439/247 |
| 9,033,722 | B2 * | 5/2015 | Kobayashi | H01R 12/712 439/248 |
| 2006/0276061 | A1 | 12/2006 | Koguchi | |
| 2015/0244093 | A1 * | 8/2015 | Funayama | H01R 12/91 439/65 |

FOREIGN PATENT DOCUMENTS

| | | |
|---|---|---|
| JP | 2002-050420 | 2/2002 |
| JP | 2002-100443 | 4/2002 |
| JP | 2003-229193 | 8/2003 |
| JP | 2007-018785 | 1/2007 |
| JP | 2011-076755 | 4/2011 |

* cited by examiner

CONNECTOR

TECHNICAL FIELD

The present invention relates to a connector that is used to connect a pair of printed circuit boards to each other, for example.

BACKGROUND ART

Heretofore, a connector of this kind has been known which includes one connector attached to one of a pair of substrates that are arranged so that one surface of each of the substrates faces each other, and the other connector attached to the other of the substrates, and in which the connectors are fitted together to connect the substrates to each other (refer to Patent Literature 1, for example).

One of the connectors includes a fixed housing that is fixed to the substrate, a movable housing that is provided so as to be freely movable with respect to the fixed housing in a fore-and-aft direction and a width direction of the connector, and a plurality of terminals each of which has one end supported by the movable housing and the other end is supported by the fixed housing. In the one of the connectors, the movable housing moves with respect to the fixed housing by using elastic deformation of a movable portion provided between the one end and the other end of each of the terminals in order to absorb a mutual position shift of each of the substrates caused by vibration or impact.

CITATION LIST

Patent Literature

Patent Literature 1: Japanese Patent Publication 2007-18785

SUMMARY OF INVENTION

Technical Problem

In the connectors above, although a mutual position shift of each of the substrates occurs in the fore-and-aft direction and the width direction of the connector, the terminal of only one of the connectors is formed so as to be elastically deformable to allow movement of the movable housing. Thus, the movable portion of the terminal is required to be sufficiently deformed in both of the fore-and-aft direction and the width direction of the connector. As a result, there is a problem in which since the movable portion of the terminal of the one of the connectors is formed so as to be substantially square in cross section with a small cross-sectional area, it is impossible to increase a permissible value of current of the terminal to cause the connector to be disadvantageous for use for large current.

The present invention is made in light of the problem above, and it is an object to provide a connector capable of increasing a permissible value of current of a terminal even in a structure in which first and second connectors are mutually freely movable in a fore-and-aft direction and a width direction.

Solution to Problem

In order to achieve the object, a connector of the present invention includes: a first connector attached to one of a pair of substrates that are arranged so that one surface of each of the substrates vertically faces each other; and a second connector attached to the other of the substrates, and the first and second connectors being fitted together to connect each of the substrates to each other, the first connector including: a first fixed housing that is fixed to the one of the substrates; a first movable housing that is arranged so as to be freely movable with respect to the first fixed housing in a fore-and-aft direction of the connector; and a first terminal that is provided with one end supported by the first movable housing and the other end supported by the first fixed housing, the first terminal including a movable portion that is elastically deformable in the fore-and-aft direction of the connector, the movable portion of the first terminal being formed so that a width of the movable portion corresponding to a width direction of the connector is larger than a thickness thereof corresponding to the fore-and-aft direction or a vertical direction of the connector, one end and the other end of the first terminal being arranged in the fore-and-aft direction of the connector at an interval, the movable portion of the first terminal being arranged between the one end and the other end of the first terminal, and the second connector including: a second fixed housing that is fixed to the other of the substrates; a second movable housing that is arranged so as to be freely movable with respect to the second fixed housing in the width direction of the connector; and a second terminal that is provided with one end supported by the second movable housing and the other end supported by the second fixed housing, the second terminal including a movable portion that is elastically deformable in the width direction of the connector, the movable portion of the second terminal being formed so that a thickness of the movable portion corresponding to the fore-and-aft direction or the vertical direction of the connector is larger than a width thereof corresponding to the width direction of the connector, one end and the other end of the second terminal being arranged in the fore-and-aft direction of the connector at an interval, the movable portion of the second terminal being arranged between the one end and the other end of the second terminal.

Accordingly, since the first terminal of the first connector is provided with the movable portion whose dimension in a width direction is larger than a dimension in a thickness direction, the first terminal can be easily elastically deformed in the fore-and-aft direction or the vertical direction of the connector. On the other hand, since the second terminal of the second connector is provided with the movable portion whose dimension in a thickness direction is larger than a dimension in a width direction, the second terminal can be easily elastically deformed in the width direction of the connector. If a mutual position shift of each of the substrates occurs in the fore-and-aft direction of the connector, the movable portion of the first terminal is elastically deformed, and if a mutual position shift of each of the substrates occurs in the width direction of the connector, the movable portion of the second terminal is elastically deformed. That is, the movable portion of the first terminal of the first connector is formed so as to be elastically deformed in the fore-and-aft direction of the connector by allowing a dimension in a width direction of the movable portion to be larger than a dimension in a thickness direction thereof, and the movable portion of the second terminal of the second connector is formed so as to be elastically deformed in the width direction of the connector by allowing a dimension in a thickness direction of the movable portion to be larger than a dimension in a width direction thereof. As compared with a movable portion that are formed so as to be sufficiently elastically deformable in both of the fore-and-aft direction and the width direction of the connector, a cross-sectional area of the movable portion of each of the first and second terminals can be increased. As a result, it is possible to increase a permissible value of current of the terminal.

Advantageous Effects of Invention

According to the present invention, even in a structure in which the first and second connectors are mutually freely movable in the fore-and-aft direction and the width direction of the connector, the permissible value of current of the terminal can be increased. Thus, the connector of the present invention is available for a connector for large current.

DESCRIPTION OF EMBODIMENTS

FIGS. 1 to 16 show one embodiment of the present invention, such as a connector that is used to connect a pair of printed circuit boards to each other. In Figures, an X direction, a Y direction, and a Z direction, show a width direction, a fore-and-aft direction, and a vertical direction, of the connector, respectively.

Figure 15:
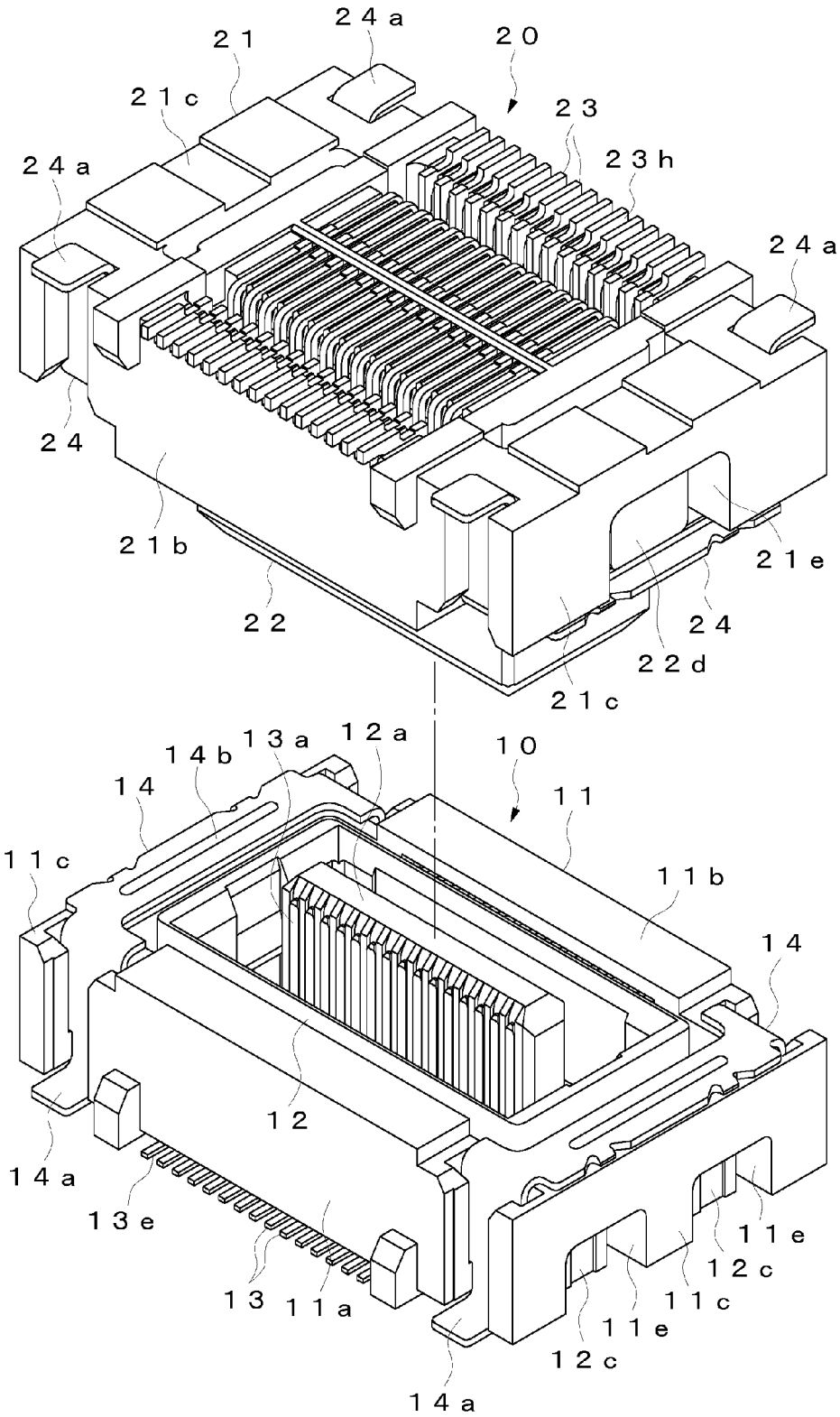
FIG. 15 is a perspective view showing a connection process of the connectors.
Figure 16:
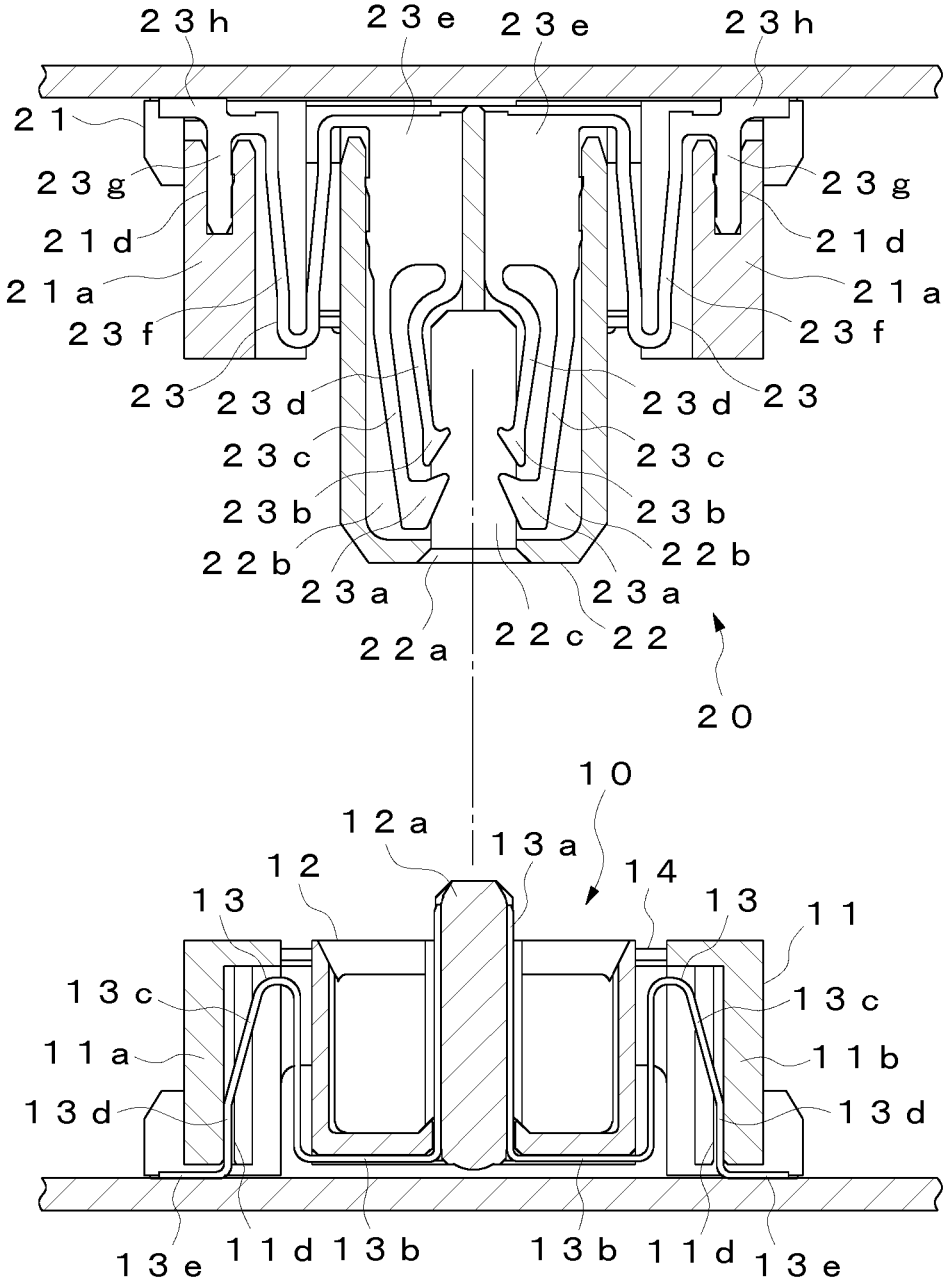
FIG. 16 is a lateral sectional view showing a connection process of the connectors.

The connector of the present embodiment includes: a first connector 10 that is attached to a substrate 1 of one of a pair of substrates 1 and 2 that are arranged so that one surface of each of the substrates faces each other; and a second connector 20 that is attached to a substrate 2 of the other thereof. Although the second connector 20 shown in each of FIGS. 15 and 16 is upside down with respect to that shown in each of FIGS. 7 to 12, a vertical direction in the description below is indicated as a vertical direction of FIGS. 7 to 12.

The first connector 10 includes: a first fixed housing 11 that is fixed to the substrate 1; a first movable housing 12 that is freely movable with respect to the first fixed housing 11; a plurality of first terminals 13 supported by the first fixed housing 11 and the first movable housing 12; a pair of first fixing members 14 with which the first fixed housing 11 is fixed to the substrate 1. Each of the first terminals 13 is arranged in a width direction of the connector at an interval as well as arranged in two rows back and front.

The first fixed housing 11 is composed of a synthetic resin molding, and is formed into a substantially rectangular parallelepiped shape in which a height dimension is smaller than a width dimension and a depth dimension. The first fixed housing 11 is composed of a front face part 11*a*, a back face part 11*b*, and right and left side face parts 11*c*, and a top face and a lower face of the first fixed housing 11 are open upward and downward, respectively. On an inner surface side of each of the front face part 11*a* and the back face part 11*b*, a plurality of fixing grooves 11*d* is provided to fix each of the first terminals 13. In each of the side face parts 11*c*, notch portions 11*e* in a substantially quadrangular shape are provided back and front by two places to regulate movement of the first movable housing 12 in a fore-and-aft direction.

The first movable housing 12 is composed of a synthetic resin molding, and is formed into a substantially rectangular parallelepiped shape in which a height dimension is smaller than a width dimension and a depth dimension. The first movable housing 12 is formed into a hollow shape in which a top face is open, and a protrusion 12*a* protruding upward from a central portion in the fore-and-aft direction of a bottom face is provided inside the first movable housing 12. The protrusion 12*a* is formed into a flat shape long in a width direction of the first movable housing 12, and each of a front face and a back face of the protrusion 12*a* is provided with a plurality of supporting grooves 12*b* to support each of the first terminals 13. The first movable housing 12 is formed into an external form smaller than an internal form of the first fixed housing 11, and is arranged in the first fixed housing 11 in a movable manner in the fore-and-aft direction and the width direction. In this case, an upper end of the first movable housing 12 is positioned at a height almost same as an upper end of the second fixed housing 21. In addition, protrusions 12*c* protruding laterally are provided back and front by two places in both side faces of the first movable housing 12, and the protrusions 12*c* are arranged in the respective notch portions 11*e* in the first fixed housing 11 in a freely movable manner in the fore-and-aft direction, the width direction, and the vertical direction.

Figure 1:
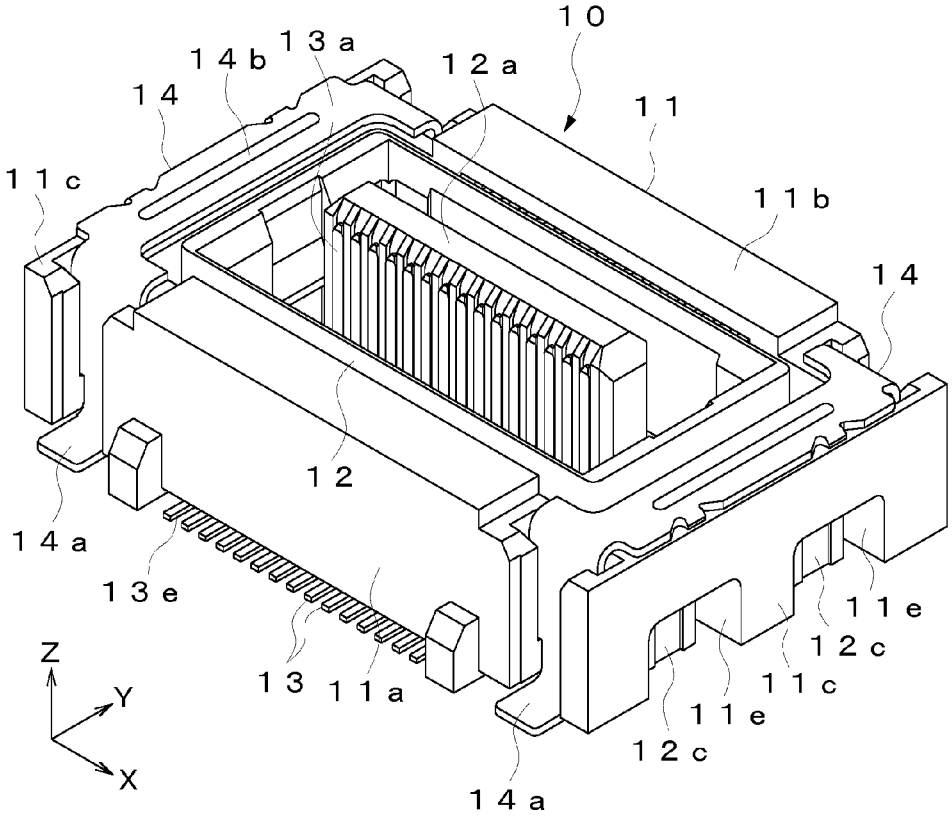
FIG. 1 is a perspective view showing a first connector of one embodiment of the present invention.
Figure 2:
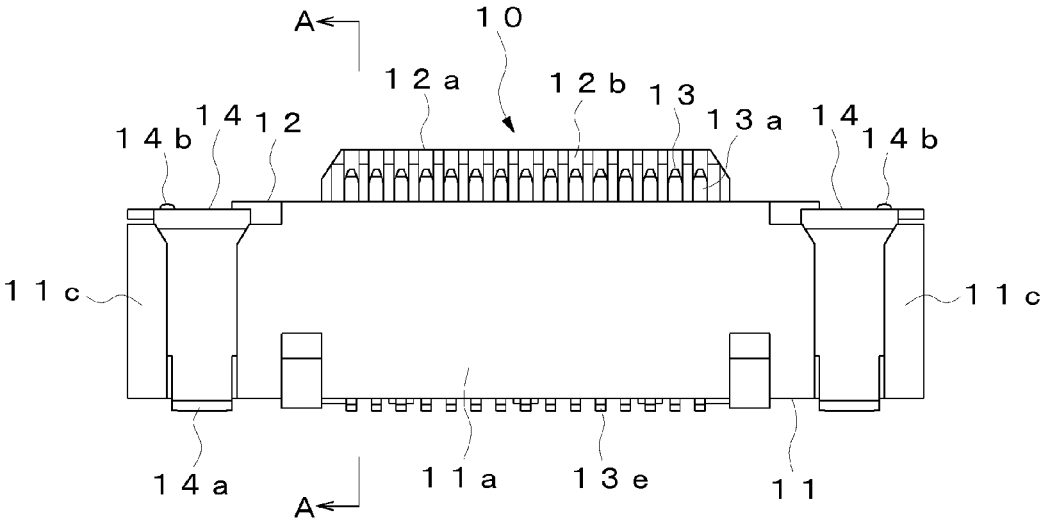
FIG. 2 is a front view of the first connector.
Figure 3:
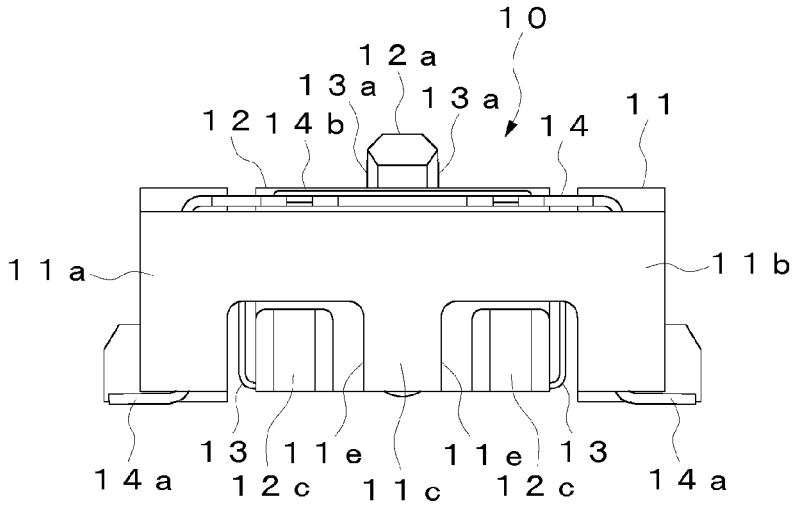
FIG. 3 is a side view of the first connector.
Figure 4:
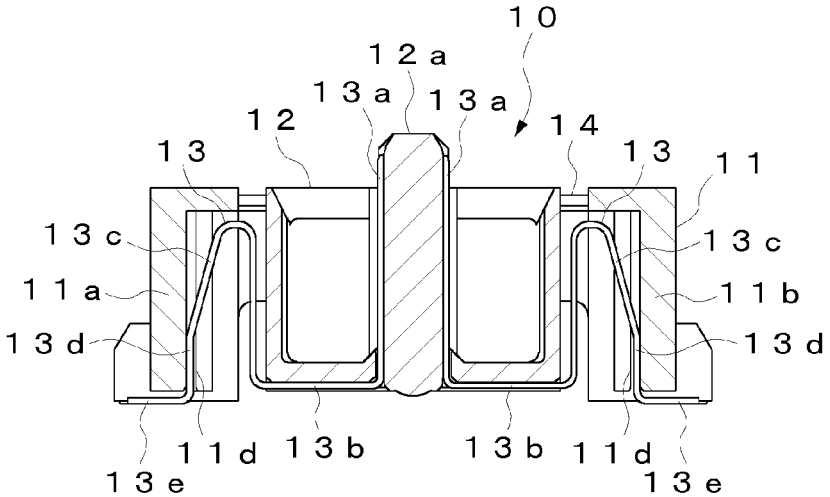
FIG. 4 is a sectional view taken along line A-A of FIG. 2.
Figure 5:
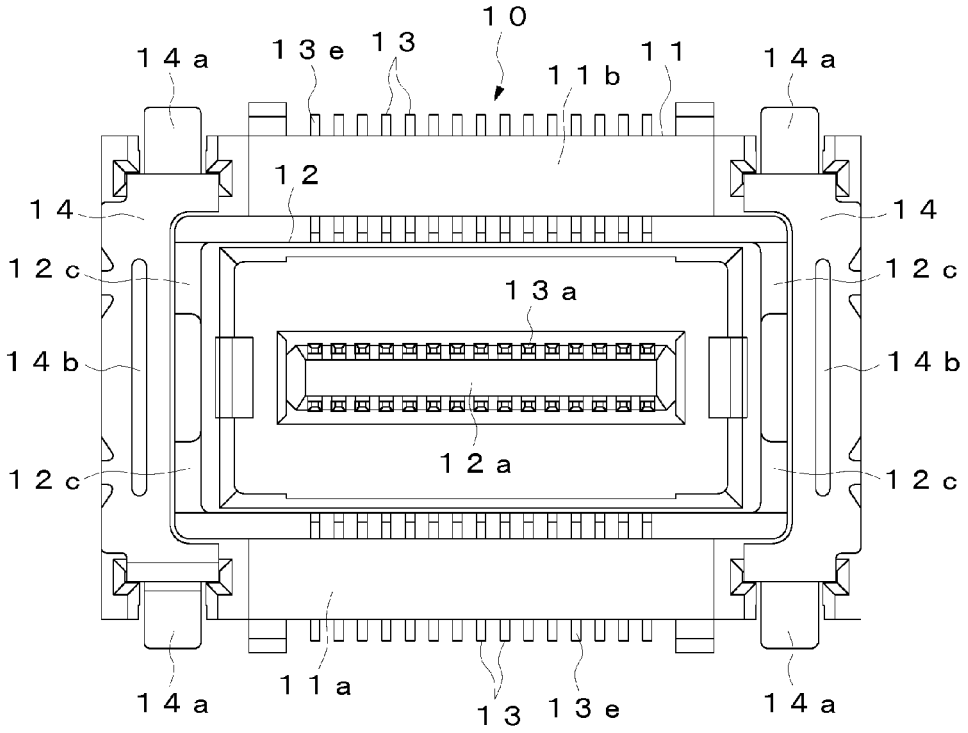
FIG. 5 is a plan view of the first connector.
Figure 6:
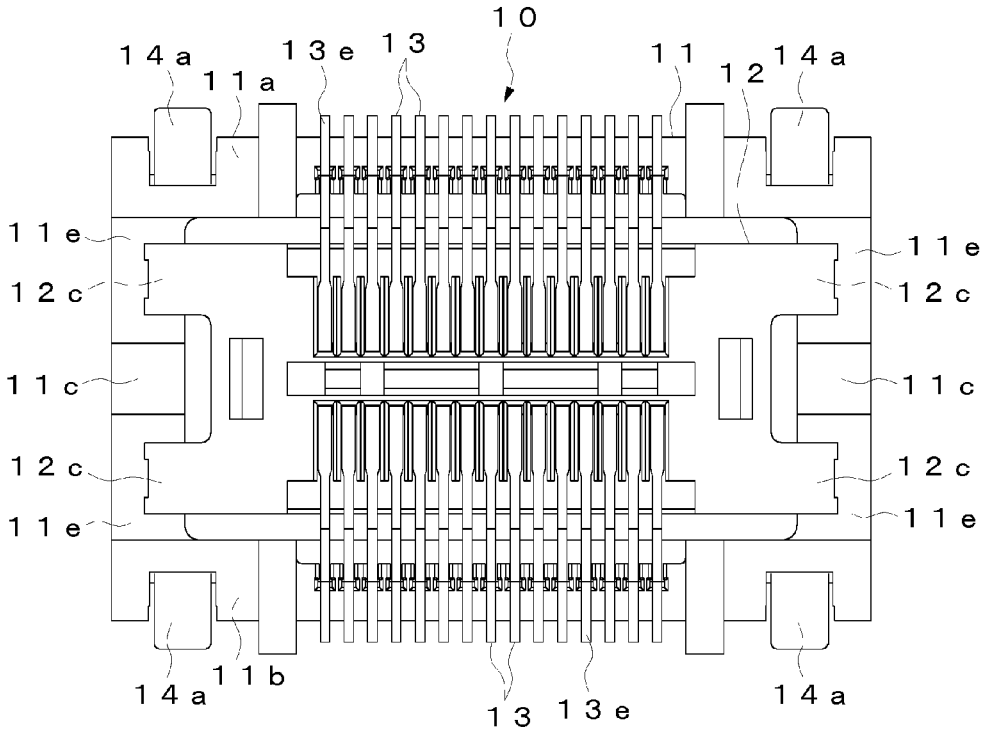
FIG. 6 is a bottom view of the first connector.
Figure 7:
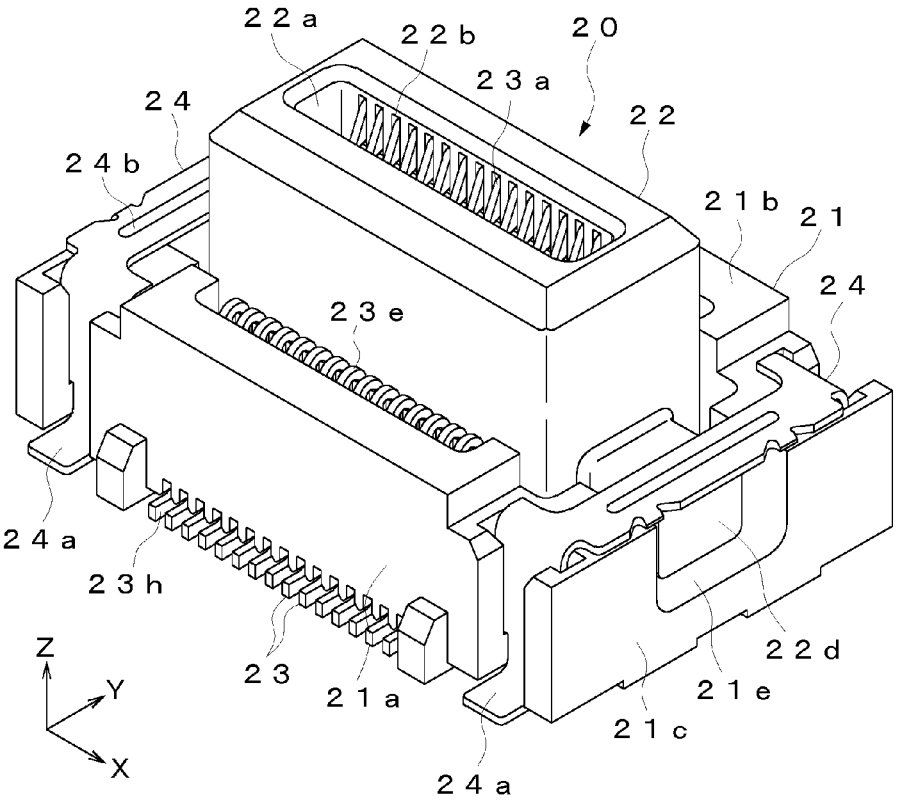
FIG. 7 is a perspective view of a second connector.
Figure 8:
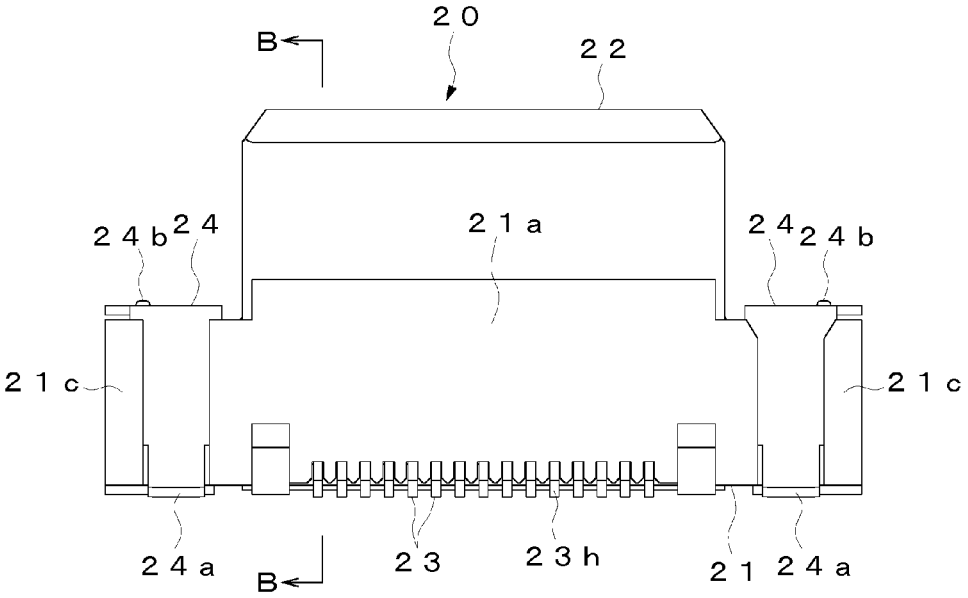
FIG. 8 is a front view of the second connector.
Figure 9:
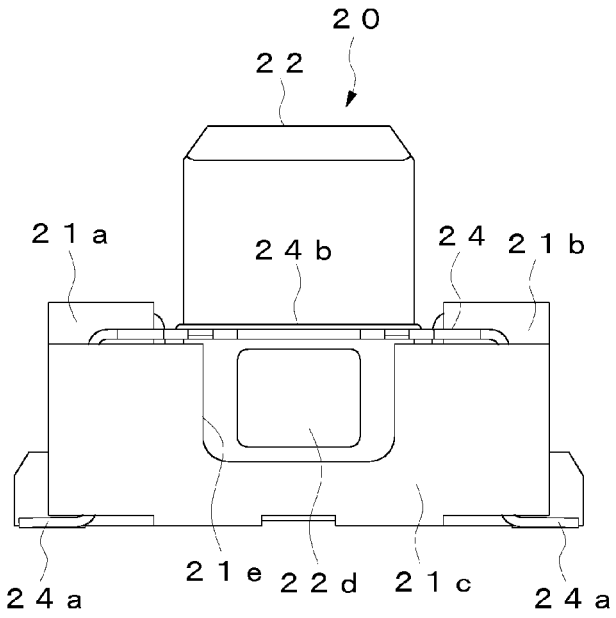
FIG. 9 is a side view of the second connector.
Figure 10:
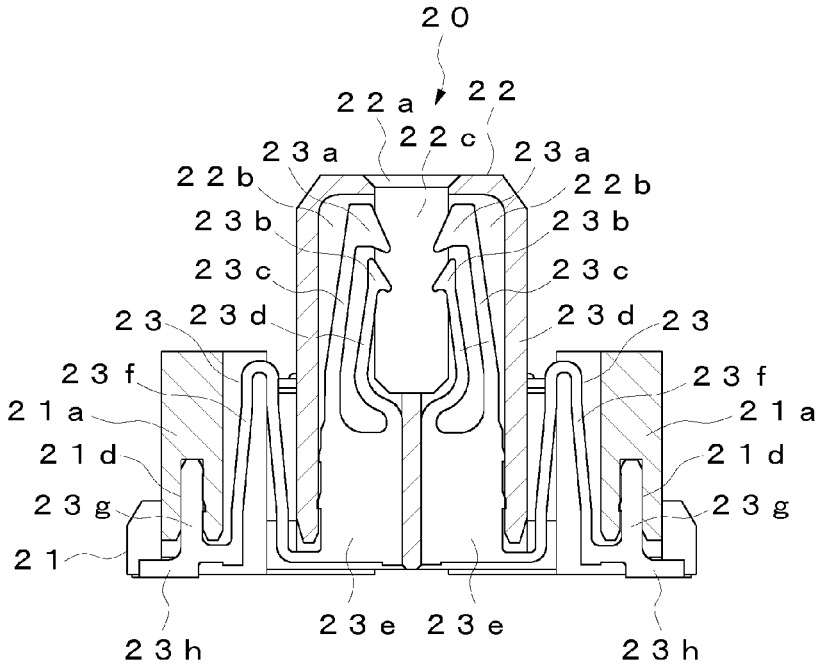
FIG. 10 is a sectional view taken along line B-B of FIG. 8.
Figure 11:
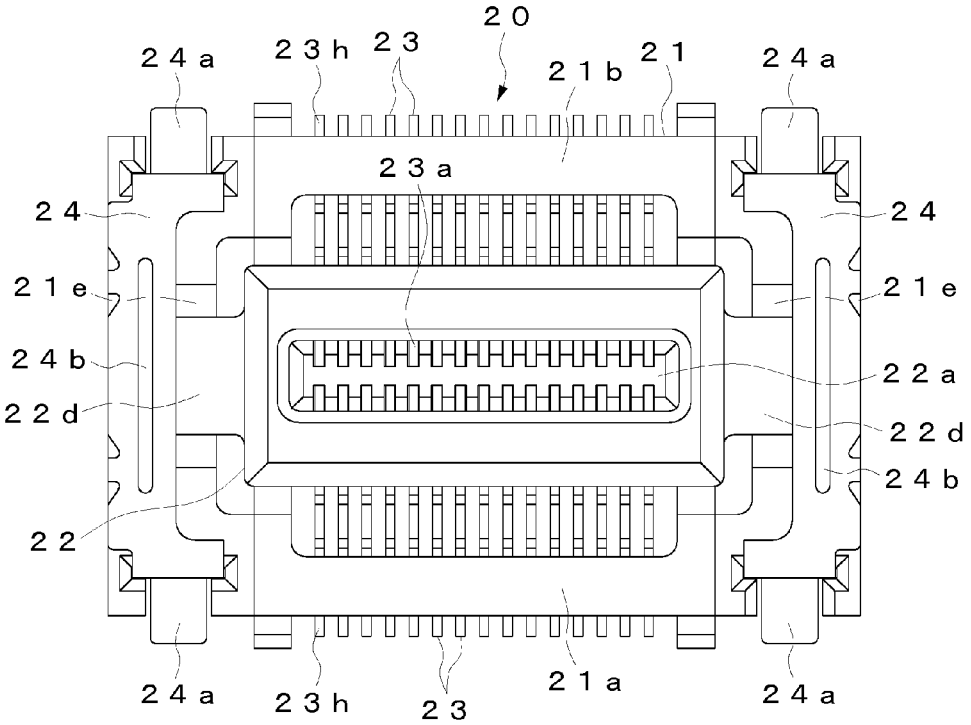
FIG. 11 is a plan view of the second connector.
Figure 12:
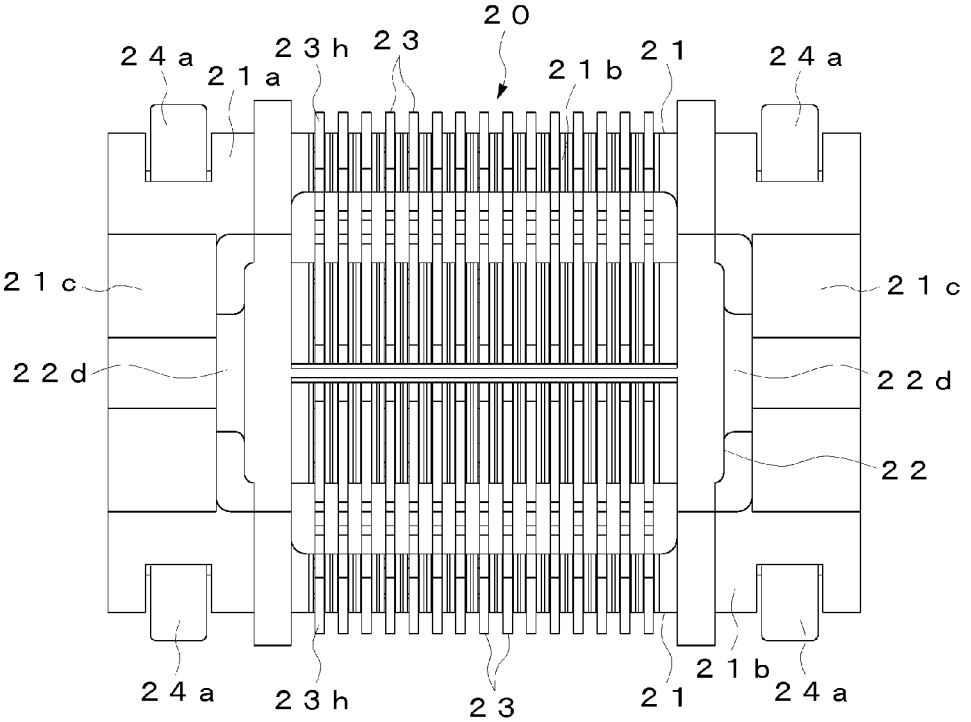
FIG. 12 is a bottom view of the second connector.
Figure 13:
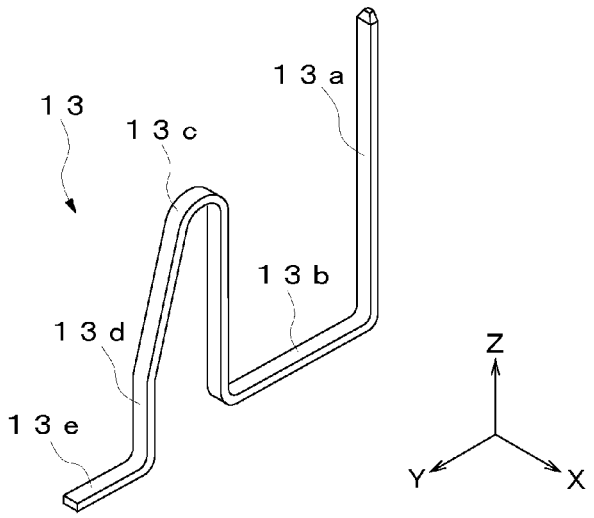
FIG. 13 is a perspective view of a first terminal.

Each of the first terminals 13 is formed by bending an electrically conductive metal plate so that a dimension in a width direction (an X direction) is larger than a dimension in a thickness direction (a Y direction or a Z direction) as shown in FIG. 13. The first terminal 13 includes: a contact portion 13*a* that is brought into contact with a terminal of the second connector 20; a first fixed piece portion 13*b* that is to be fixed to the first movable housing 12; a movable portion 13*c* that is elastically deformable in the fore-and-aft direction of the connector; a second fixed piece portion 13*d* that is to be fixed to the first fixed housing 11; and a substrate connection portion 13*e* that is to be connected to the substrate 1. The contact portion 13*a* is formed so as to linearly extend in the vertical direction, and is supported in a support groove 12*b* of the first movable housing 12. The first fixed piece portion 13*b* is formed so as to extend in the fore-and-aft direction from a lower end of the contact portion 13*a*, and is fixed to a lower face of the first movable housing 12. The movable portion 13*c* is formed so as to extend upward along an outer face of the first movable housing 12 from the first fixed piece portion 13*b*, and is formed so as to bend downward from an upper end close to the upper end of the first movable housing 12 in an inverted U-shape to be elastically deformed in the fore-and-aft direction (Y direction) of the connector from the upper end as a base point. The second fixed piece portion 13*d* is formed so as to extend downward from one of lower ends of the movable portion 13*c*, and is fixed to a fixing groove 11*d* of the first fixed housing 11. The substrate connection portion 13*e* is formed so as to extend in the fore-and-aft direction from a lower end of the second fixed piece portion 13*d*, and extends from below the front face part 11*a* or the back face part 11*b* of the first fixed housing 11 to the outside of the first fixed housing 11. That is, one end side of the first terminal 13 (first fixed piece portion 13*b* side) and the other end side thereof (second fixed piece portion 13*d* side) are arranged in the fore-and-aft direction of the connector at an interval, and the movable portion 13*c* is arranged between the end sides.

Each of the first fixing members 14 is formed by bending a metal plate, and is arranged in one of both sides of the first fixed housing 11 in the width direction. The first fixing member 14 is formed in a substantially U-shape turned sideways so as to extend from a top face of the side face parts 11*c* of the first fixed housing 11 to a front face side and a back face side of the first fixed housing 11, and both back and front sides of the first fixing member 14 are fixed to a front face side and a back face side of the side face part 11*c*, respectively. Each of both ends of the first fixing member 14 is provided with a fixed piece portion 14*a* to be soldered to the substrate 1. The fixed piece portion 14*a* is formed so as to extend in the fore-and-aft direction. In addition, a top face of the first fixing members 14 is provided with a protrusion 14*b* extending in the fore-and-aft direction.

The second connector 20 includes: a second fixed housing 21 that is fixed to the substrate 1; the second movable housing 22 that is freely movable with respect to the second fixed housing 21; a plurality of second terminals 23 supported by the second fixed housing 21 and the second movable housing 22; a pair of second fixing members 24 with which the second fixed housing 21 is fixed to the substrate 2. Each of the second terminals 23 is arranged in a width direction of the connector at an interval as well as arranged in two rows back and front.

The second fixed housing 21 is composed of a synthetic resin molding, and is formed into a substantially rectangular parallelepiped shape in which a height dimension is smaller than a width dimension and a depth dimension. The second fixed housing 21 is composed of a front face part 21*a*, a back face part 21*b*, and right and left side face parts 21*c*, and a top face and a lower face of the second fixed housing 21 are open upward and downward, respectively. On a lower end side of each of the front face part 21*a* and the back face part 21*b*, a plurality of fixing holes 21*d* is provided to fix each of the second terminals 23. In each of the side face parts 21*c*, notch portions 21*e* in a substantially quadrangular shape are provided to regulate movement of the second movable housing 22 in the fore-and-aft direction.

The second movable housing 22 is composed of a synthetic resin molding, and is formed into a substantially rectangular parallelepiped shape in which a height dimension is larger than a width dimension and a depth dimension. In a top face of the second movable housing 22, there is provided an insertion opening 22*a* into which the protrusion 12*a* of the first movable housing 12 is to be inserted, and the insertion opening 22*a* is formed horizontally long so as to extend in the width direction of the first movable housing 12. In the second movable housing 22, there is provided a plurality of terminal holes 22*b* into which respective second terminals 23 are arranged. The plurality of terminal holes 22*b* is arranged in the width direction of the connector at an interval as well as arranged in two rows back and front. An upper side of each of the terminal holes 22*b* opens toward the center of the inside of the second movable housing 22 in the fore-and-aft direction, and between the upper sides of each of the terminal holes 22*b* in the front row and the back row, there is provided an insertion part 22*c* into which the protrusion 12*a* of the first movable housing 12 is to be inserted through the insertion opening 22*a*. The second terminal 23 is configured to be fixed to a lower side of each of the terminal holes 22*b*, and a lower end of each of the terminal holes 22*b* opens downward. The second movable housing 22 is formed into an external form smaller than an internal form of the second fixed housing 21, and is arranged in the second fixed housing 21 in a movable manner in the fore-and-aft direction and the width direction.

Figure 14:
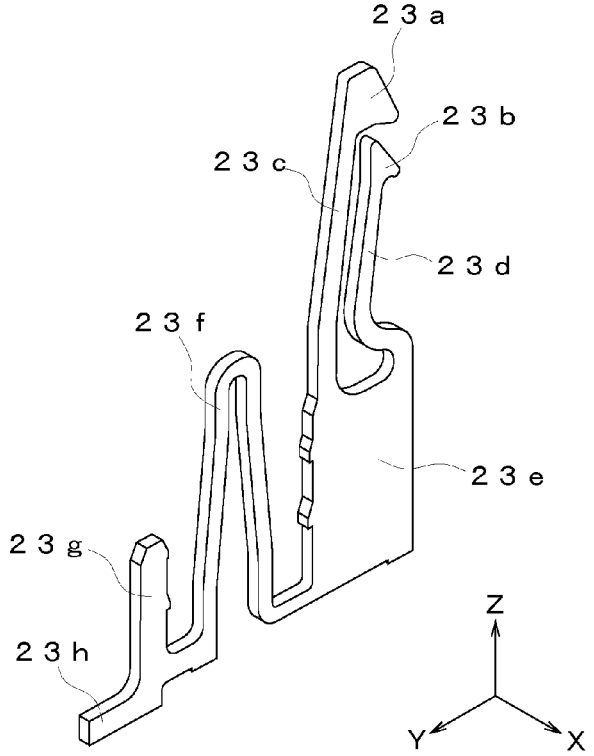
FIG. 14 is a perspective view of a second terminal.

Each of the second terminals 23 is formed by punching an electrically conductive metal plate so that a dimension in a thickness direction (the Y direction or the Z direction) is larger than a dimension in a width direction (the X direction) as shown in FIG. 14. The second terminal 23 includes: a first contact portion 23*a* and a second contact portion 23*b* that are brought into contact with the first terminal 13 of the first connector 10; a first elastic piece portion 23*c* and a second elastic piece portion 23*d* that are elastically deformable in a direction in which the portions are brought into contact with the first terminal 13; a first fixed piece portion 23*e* that is to be fixed to the second movable housing 22; a movable portion 23*f* that is elastically deformable in the width direction of the connector; and a second fixed piece portion 23*g* that is to be fixed to the second fixed housing 21; and a substrate connection portion 23*h* that is to be connected to the substrate 2. The first contact portion 23*a* and the second contact portion 23*b* are formed into a substantially triangle shape, and protrude from an upper side of each of the terminal holes 22*b* into the insertion part 22*c*. In this case, the respective contact portions 23*a* and 23*b* are arranged in the vertical direction at an interval so that the first contact portion 23*a* is positioned above the second contact portion 23*b*. The first elastic piece portion 23*c* is formed so as to extend upward from an upper end of the first fixed piece portion 23*e*, and the upper end is provided with the first contact portion 23*a*. The second elastic piece portion 23*d* is formed so as to extend upward from the upper end of the first fixed piece portion 23*e*, and the upper end is provided with the second contact portion 23*b*. In this case, the respective elastic piece portions 23*c* and 23*d* are arranged in the fore-and-aft direction at an interval so that the second elastic piece portion 23*b* is positioned closer to a central side of the connector in the fore-and-aft direction than the first elastic piece portion 23*c*. The first fixed piece portion 23*e* is formed so as to extend downward from an lower end of each of the elastic piece portions 23*c* and 23*d*, and is fixed to a lower side of the terminal holes 22*b*. The movable portion 23*f* is formed so as to extend upward along an outer face of the second movable housing 22 from an lower end side of the first fixed piece portion 23*e*, and is formed so as to bend downward from an upper end close to a substantially central portion of the second movable housing in the vertical direction in an inverted U-shape to be elastically deformed in the width direction (X direction) of the connector from the upper end as a base point. The second fixed piece portion 23*g* is formed so as to extend upward from one of lower ends to the movable portion 23*f*, and is fixed in a fixing hole 21*d* of the second fixed housing 21. The substrate connection portion 23*h* is formed so as to extend in the fore-and-aft direction from a lower end of the second fixed piece portion 23*g*, and extends from below the front face part 21*a* or the back face part 21*b* of the second fixed housing 21 to the outside of the second fixed housing 21. That is, one end side of the second terminal 23 (first fixed piece portion 23*e* side) and the other end side thereof (second fixed piece portion 23*g* side) are arranged in the fore-and-aft direction of the connector at an interval, and the movable portion 23*f* is arranged between the end sides.

Each of the second fixing members 24 is formed by bending a metal plate, and is arranged in one of both sides of the second fixed housing 21 in the width direction. The second fixing member 24 is formed in a substantially U-shape turned sideways so as to extend from a top face of the side face parts 21*c* of the second fixed housing 21 to a front face side and a back face side of the second fixed housing 21, and both back and front sides of the second fixing member 24 are fixed to a front face side and a back face side of the side face part 21*c*, respectively. Each of both ends of the second fixing member 24 is provided with a fixed piece portion 24*a* to be soldered to the substrate 2. The fixed piece portion 24*a* is formed so as to extend in the fore-and-aft direction. In addition, a top face of the second fixing members 24 is provided with a protrusion 24*b* extending in the fore-and-aft direction.

In the connector configured as above, the fixed piece portion 14*a* of each of the first fixing members 14, and the substrate connection portion 13*e* of each of the first terminals 13, of the first connector 10, are soldered to the substrate 1, to fix the first fixed housing 11 of the first connector 10 to the substrate 1. In addition, the fixed piece portion 24*a* of each of the second fixing members 24, and the substrate connection portion 23*h* of each of the second terminals 23, of the second connector 20, are soldered to the substrate 2, to fix the second fixed housing 21 of the second connector 20 to the substrate 2.

Next, in a case where the first connector 10 and the second connector 20 are connected, as shown in FIGS. 15 and 16, the second connector 20 and the substrate 2 are turned upside down so that the first movable housing 12 of the first connector 10 and the second movable housing 22 of the second connector 20 are fitted to each other. Then, the second movable housing 22 is inserted into the first movable housing 12, and the protrusion 12*a* of the first movable housing 12 is inserted into the insertion part 22*c* in the second movable housing 22 through the insertion opening 22*a* of the second movable housing 22. Accordingly, each of the contact portions 13*a* of the first terminals 13 is press-fitted into a gap between each of the first contact portions 23*a* and a gap between each of the second contact portions 23*b*, of the second terminals 23, and each of the contact portions 13*a* of the first terminals 13 and each of the first and second contact portions 23*a* and 23*b* of the second terminals 23 are brought into contact with each other, so that each of the first terminals 13 and each of the second terminals 23 are connected. Then, after the first contact portion 23*a* of the second terminal 23 is brought into contact with the contact portion 13*a* of the first terminals 13, the second contact portion 23*b* of the second terminal 23 is brought into contact with the contact portion 13*a* of the first terminals 13. Thus, even if foreign material, such as dust and contamination, is attached to the contact portion 13*a* of the first terminal 13, the second contact portion 23*b* is brought into contact with the contact portion 13*a* after the first contact portion 23*a* removes the foreign material.

In the connection state, if each of the substrates 1 and 2 mutually has a relative position shift in the fore-and-aft direction (Y direction) or the vertical direction (Z direction) of the connector, the first movable housing 12 of the first connector moves in the fore-and-aft direction (Y direction) or the vertical direction (Z direction) of the connector with respect to the first fixed housing 11 to absorb the mutual position shift of each of the substrates 1 and 2 with respect to the fore-and-aft direction or the vertical direction of the connector. In addition, if each of the substrates 1 and 2 mutually has a relative position shift in the width direction (X direction) of the connector, the second movable housing 12 of the second connector 20 moves in the width direction (X direction) of the connector with respect to the second fixed housing 21 to absorb the mutual position shift of each of the substrates 1 and 2 with respect to the width direction of the connector.

That is, since each of the first terminals 13 of the first connector 10 has the movable portion 13*c* in which a dimension in the width direction (X direction) is larger than a dimension in the thickness direction (Y direction or Z direction), each of the first terminals 13 is easily elastically deformed in the fore-and-aft direction (Y direction) or the vertical direction (Z direction) of the connector. In addition, since each of the second terminals 23 of the second connector 20 has the movable portion 23*f* in which a dimension in the thickness direction (Y direction or Z direction) is larger than a dimension in the width direction (X direction), each of the second terminals 23 is easily elastically deformed in the width direction (X direction) of the connector. Thus, if a mutual position shift of each of the substrates 1 and 2 occurs in the fore-and-aft direction (Y direction) of the connector, the movable portion 13*c* of each of the first terminals 13 is more elastically deformed than the movable portion 23*f* of each of the second terminals 23, and if a mutual position shift of each of the substrates 1 and 2 occurs in the width direction (X direction) of the connector, the movable portion 23*f* of each of the second terminals 23 is more elastically deformed than the movable portion 13*c* of each of the first terminals 13.

In addition, the movable portion 13*c* of each of the first terminals 13 is arranged between one end side (first fixed piece portion 13*b* side) of the first terminal 13 and the other end side (second fixed piece portion 13*d* side) thereof, and the one end side of the first terminal 13 and the other end side thereof are mutually arranged in the fore-and-aft direction of the connector at an interval. As a result, even if the movable portion 13*c* of the first terminal 13 is formed long in the vertical direction, a vertical dimension of the first terminal 13 does not increase. Likewise, the movable portion 23*f* of each of the second terminals 23 is arranged between one end side (first fixed piece portion 23*e* side) of the second terminal 23 and the other end side (second fixed piece portion 23*g* side) thereof, and the one end side of the second terminal 23 and the other end side thereof are mutually arranged in the fore-and-aft direction of the connector at an interval. As a result, even if the movable portion 23*f* of the second terminal 23 is formed long in the vertical direction, a vertical dimension of the second terminal 23 does not increase.

As above, according to the present embodiment, the connector includes: the first connector 10 provided with the first terminals 13 each of which has the movable portion 13*c* that is formed so that a dimension in its width direction is larger than a dimension in its thickness direction to be elastically deformed in the fore-and-aft direction (Y direction) of the connector; and the second connector 20 provided with the second terminals 23 each of which has the movable portion 23*f* that is formed so that a dimension in its thickness direction is larger than a dimension in its width direction to be elastically deformed in the width direction (X direction) of the connector. As a result, as compared with a terminal that is formed so as to be sufficiently elastically deformable in both of the fore-and-aft direction and the width direction of the connector, it is possible to increase a cross-sectional area of each of the movable portions 13*c* and 23*f*, so that a permissible value of current of each of the terminals 13 and 23 can be increased. Accordingly, even in a structure in which the first and second connectors 10 and 20 are mutually freely movable in the fore-and-aft direction and the width direction of the connector, the permissible value of current of each of the terminals (13 and 23) can be increased. Thus, the connector of the present invention is available for a connector for large current.

In this case, the one end side (first fixed piece portion 13*b* side) of the first terminal 13 and the other end side (second fixed piece portion 13*d* side) are mutually arranged in the fore-and-aft direction of the connector at an interval, and the movable portion 13*c* of the first terminal 13 is configured to be arranged between the end sides, so that it is possible to form the movable portion 13*c* long in the vertical direction without increasing a vertical dimension of the first terminal 13. In addition, the one end side (first fixed piece portion 23*e* side) of the second terminal 23 and the other end side (second fixed piece portion 23*g* side) are mutually arranged in the fore-and-aft direction of the connector at an interval, and the movable portion 23*f* of the second terminal 23 is configured to be arranged between the end sides, so that it is possible to form the movable portion 23*f* long in the vertical direction without increasing a vertical dimension of the second terminal 23. Accordingly, it is possible to increase the amount of movement of the first and second movable housings 12 and 22 without increasing in size of the first and second connectors 10 and 20 in the vertical direction. Thus, even if an interval between each of the substrates 1 and 2 is narrow and a mutual position shift of each of the substrates 1 and 2 is large, the connector of the present invention is advantageous.

In this case, since the movable portion 13*c* of the first terminal 13 is formed so as to bend in the vertical direction, it is possible to allow flexural deformation from the bent portion as a base point to occur in the thickness direction in which a dimension is smaller than that in the width direction. As a result, it is possible to easily elastically deform the first terminal 13.

In addition, since the movable portion 23*f* of the second terminal 23 is formed so as to bend in the vertical direction, it is possible to allow flexural deformation from the bent portion as a base point to occur in the width direction in which a dimension is smaller than that in the thickness direction. As a result, it is possible to easily elastically deform the second terminal 23.

Further, the first terminal 13 is provided with the contact portion 13*a* that is brought into contact with the second terminal 23, and the second terminal 23 is provided with the first and second contact portions 23*a* and 23*b* that are brought into contact with the contact portion 13*a* of the first terminals 13, and that are elastically deformable, and the first and second contact portions 23*a* and 23*b* of the second terminal 23 are arranged at an interval in a direction in which the connectors are fitted to each other. As a result, even if foreign material, such as dust and contamination, is attached to the contact portion 13*a* of the first terminal 13, it is possible to allow the second contact portion 23*b* to be brought into contact with the contact portion 13*a* after the first contact portion 23*a* removes the foreign material. Accordingly, it is possible to provide reliable continuity between the first terminal 13 and the second terminal 23.

In the embodiment above, the structure of each of the connectors 10 and 20 is described on the basis of a facing direction of each of the substrates 1 and 2 that is the vertical direction. However, if each of the substrates is arranged so as to face each other in a direction other than the vertical direction, a facing direction of the substrates corresponds to the vertical direction of the present invention.

REFERENCE SIGNS LIST

1, 2 . . . Substrate
10 . . . First connector
11 . . . First fixed housing
12 . . . First movable housing
13 . . . First terminal
13*c* . . . Movable portion
20 . . . Second connector
21 . . . Second fixed housing
22 . . . Second movable housing
23 . . . Second terminal
23*f* . . . Movable portion.

The invention claimed is:

1. A connector comprising:

a first connector attached to one of a pair of substrates that are arranged so that one surface of each of the substrates vertically faces each other; and a second connector attached to the other of the substrates, the first and second connectors being fitted together to connect each of the substrates to each other, the first connector including:

a first fixed housing that is fixed to the one of the substrates;

a first movable housing that is arranged so as to be freely movable with respect to the first fixed housing in a fore-and-aft direction of the connector; and a first terminal that is provided with one end supported by the first movable housing and the other end supported by the first fixed housing, the first terminal including a movable portion that is elastically deformable in the fore-and-aft direction of the connector, the movable portion of the first terminal being formed so that a width of the movable portion corresponding to a width direction of the connector is larger than a thickness thereof corresponding to the fore-and-aft direction or a vertical direction of the connector, one end and the other end of the first terminal being arranged in the fore-and-aft direction of the connector at an interval, and the movable portion of the first terminal being arranged between the one end and the other end of the first terminal, the second connector including:

a second fixed housing that is fixed to the other of the substrates;

a second movable housing that is arranged so as to be freely movable with respect to the second fixed housing in the width direction of the connector; and a second terminal that is provided with one end supported by the second movable housing and the other end supported by the second fixed housing, the second terminal including a movable portion that is elastically deformable in the width direction of the connector, the movable portion of the second terminal being formed so that a thickness of the movable portion corresponding to the fore-and-aft direction or the vertical direction of the connector is larger than a width thereof corresponding to the width direction of the connector, one end and the other end of the second terminal being arranged in the fore-and-aft direction of the connector at an interval, and the movable portion of the second terminal being arranged between the one end and the other end of the second terminal.

2. The connector according to claim 1, wherein the movable portion is formed so as to bend in the vertical direction.

3. The connector according to claim 1, wherein the first terminal is provided with a contact portion that is brought into contact with the second terminal, and the second terminal is provided with first and second contact portions that are brought into contact with the contact portion of the first terminals, and that are elastically deformable, and wherein the first and second contact portions of the second terminal are arranged at an interval in a direction in which the connectors are fitted to each other.

* * * * *